US005226379A

United States Patent [19]

Everett

[11] Patent Number: 5,226,379

[45] Date of Patent: Jul. 13, 1993

[54] PROCESS FOR EDGING OPENWORK FABRIC AND PRODUCT PRODUCED THEREBY

[76] Inventor: Sharon L. Everett, 3820 San Mateo, Plano, Tex. 75023

[21] Appl. No.: 569,843

[22] Filed: Aug. 20, 1990

[51] Int. Cl.[5] ..... D05B 35/02; D05B 3/12

[52] U.S. Cl. ..... 112/262.1; 112/139; 112/141; 112/417; 112/269.1

[58] Field of Search ..... 112/137, 139, 141, 262.1, 112/417, 418, 151, 152, 153, 162, 240, 265.1, 265.2, 266.1, 267.1, 268.1, 269.1, 462, 10, 121.13, 142, 235, 302, 413, 423, 424, 425, 437; 57/243, 244, 903

[56] References Cited

U.S. PATENT DOCUMENTS

| | | | |
|---|---|---|---|
| 198,867 | 1/1878 | Bigelow | 112/417 |
| 324,082 | 8/1885 | Charmbury | 112/417 |
| 653,403 | 7/1900 | Robinson | 112/139 |
| 859,188 | 7/1907 | Amason | 112/139 |
| 988,528 | 4/1911 | Woehrle | 112/139 |
| 2,562,780 | 7/1951 | Ferris | 112/139 |
| 2,824,534 | 2/1958 | Cramer | 112/417 |
| 2,839,018 | 6/1958 | Mulkey | 112/139 |
| 3,123,035 | 3/1964 | Jamison | 57/903 X |
| 3,867,890 | 2/1975 | Hamilton et al. | 112/262.1 |
| 3,867,891 | 2/1975 | Grabher | 112/166 |
| 4,069,781 | 1/1978 | Andersson | 112/438 |
| 4,246,857 | 1/1981 | Gonnai | 112/254 |
| 4,331,089 | 5/1982 | Widmer | 112/465 X |
| 4,625,664 | 12/1986 | Duell | 112/262.1 |
| 4,862,816 | 9/1989 | Hanyu et al. | 112/235 X |
| 4,981,095 | 1/1991 | Sturm et al. | 112/417 |

OTHER PUBLICATIONS

Adele P. Margolis, "Fashion Sewing For Everyone", 1974, pp. 147–148 (Doubleday & Co.).

Grace Rogers Cooper, "The Invention of the Sewing Machine", (Smithsonian), 1968, pp. 63–64, 122–123, 135.

Frances Blondin, "The New Encyclopedia of Modern Sewing", 1946, (Wm. H. Wise & Co.), 1946, pp. 16, 315.

*Primary Examiner*—Clifford D. Crowder
*Assistant Examiner*—Ismael Izaguirre
*Attorney, Agent, or Firm*—Timmons & Kelly

[57] ABSTRACT

A process for edging a fabric which includes the steps of rolling the edge of the fabric loosely and then sewing the rolled edge with a tight zig-zag stitch which overlaps the outer fold of the rolled edge. In one arrangement, the zig-zag stitch is wider than the rolled portion and completely crosses over the rolled edge. A stiffener is added in one arrangement.

54 Claims, 1 Drawing Sheet

PROCESS FOR EDGING OPENWORK FABRIC AND PRODUCT PRODUCED THEREBY

DESCRIPTION

1. Technical Field

The present invention relates generally to cloth products and in particular to methods for hemming edges of fabric.

In manufacturing cloth products, it has long been the practice to hem exposed edges of the cloth, providing a neater appearance and preventing the cloth from raveling. Producing a neat hem for light fabrics, and in particular for openwork fabrics such as veils or nets, has been a vexing industry problem. In an attempt to circumvent or hide the problem, it has become common to border such fabrics with ribbon or other adornment.

2. Background Art

Hems for cloth edges are normally formed of a single or double fold with stitching along the cloth side of the hem. Such hems normally are flat, especially after washing or pressing. A zig-zag stitch has been used on top of such hems to create a scalloped appearance. In such an application, the stitch is typically from about 3 to about 4.5 millimeters long and from about 3.5 to about 3.75 millimeters wide. The zig-zag stitch in these applications sometimes overlap the hem on the cloth side. One result of this use of a zig-zag stitch is to ensure that the hem is flat, not always a desired effect. Such an edge would have almost no practicality for an openwork fabric.

One attempt to create a rolled appearance for a hem has been the use of a surged stitch, a stitch which uses three threads to create a "coil" of continuous loops. Although this gives somewhat the appearance of a rolled edge, the result is still the creation of a flat edge.

There is a special class of stitches used for edging known as overcast stitches. These stitches reach just to the edge of the material, but they are loose stitches which leave a flat edge. The width of the stitches are not much greater than the length if greater at all.

DISCLOSURE OF INVENTION

A process according to the present invention for producing a hem in an edge of fabric, includes rolling the edge of the fabric to be hemmed and sewing the rolled edge with a zig-zag stitch which overlaps the outer fold of the hem. In one arrangement, the hem is wider than the rolled portion of the edge and the zig-zag stitches completely cross over the rolled edge. Rolling the edge can be accomplished by hand or by feeding the edge of the fabric loosely into a folder such as a rolled hemmer or a commercial folder.

In a preferred form, the edge settings would be 3 millimeters in width and 0.02 millimeters in length. These would be the typical settings on a machine such as a Viking sewing machine. The calibrations may be labeled differently on a commercial machine, but length and width of the stitches would still be the same. In general, the width would be from about 2 to about 4 millimeters, and the length would be from about 0.01 to about 1.00 millimeters so that the zig-zag stitches would be much tighter, i.e. shorter and closer together, than what would be used for a scalloped appearance in addition to overlapping the outer fold of the hem. A stiffener such as wire or fishing line can be placed stiffener such as wire or fishing line can be placed along the edge as it is folded so that the wire or line is within the roll of the fabric and will be within the zig-zag stitches. Cotton thread can be used both in the upper spool and the lower bobbin, but filament can be substituted for one or both of these threads to produce a thinner or thicker edging.

These and other objects, advantages and features of this invention will be apparent from the following description taken with reference to the accompanying drawing, wherein is shown the preferred embodiments of the invention.

BEST MODE FOR CARRYING OUT THE INVENTION

Figure 1:
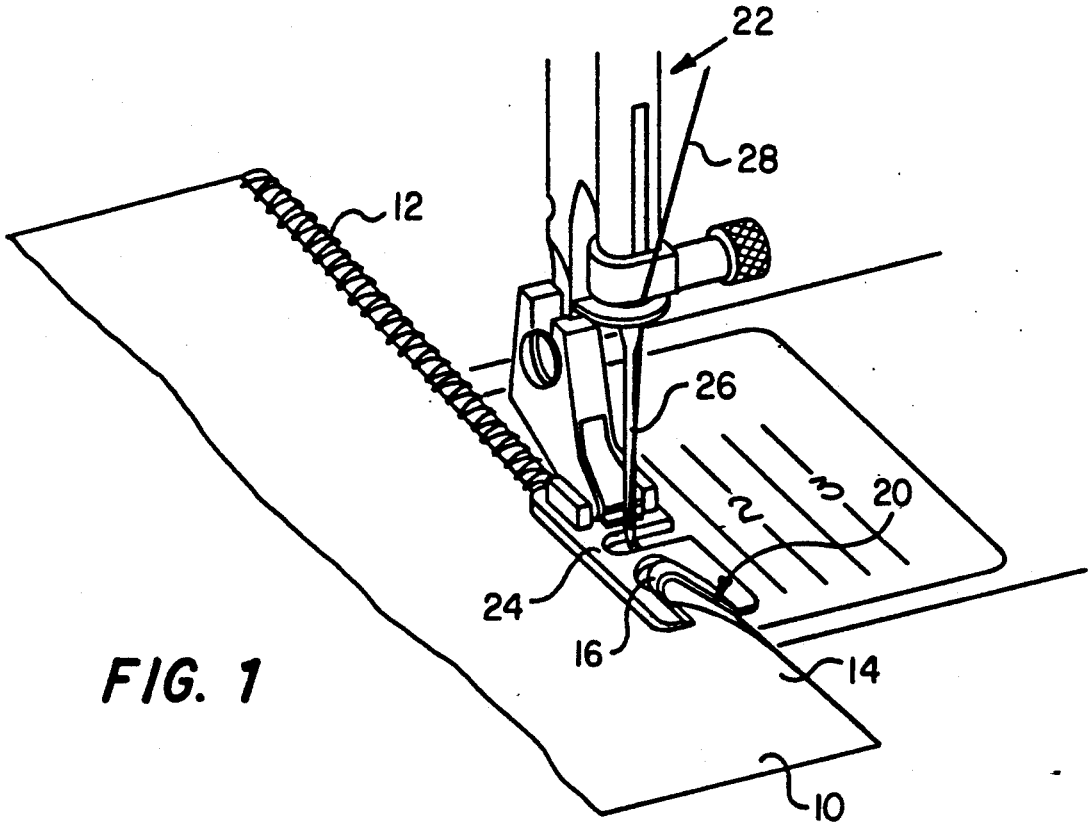
FIG. 1 is a left side perspective view of a sewing machine needle and presser foot fitted with a rolled hemmer, along with a hemmed edge of fabric according to the present invention (not to scale)
Figure 2:
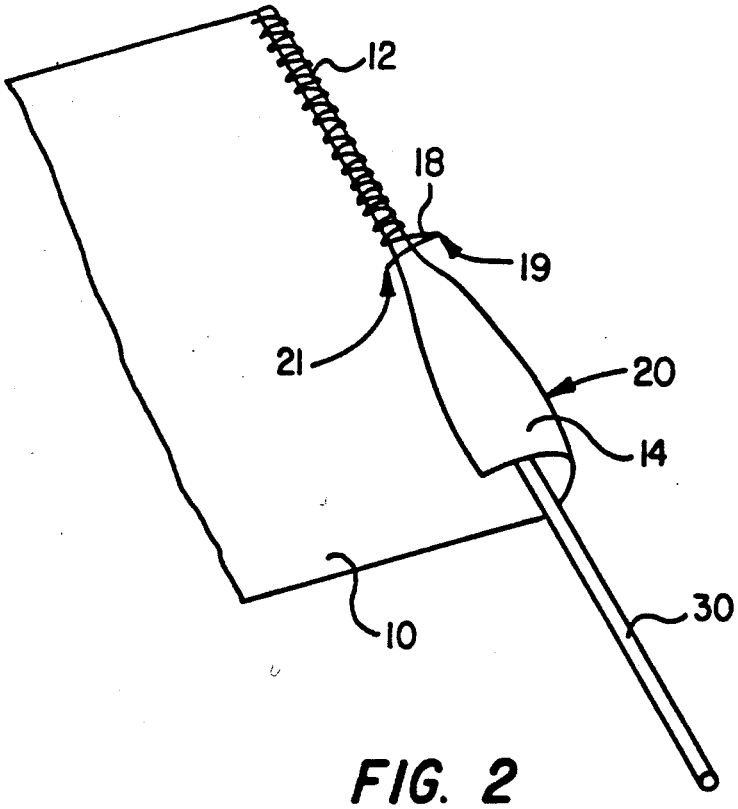
FIG. 2 is a hemmed edge of a fabric according to the present invention including a stiffener in which similar elements are given the same reference numerals as in FIG. 1 (not to scale).

Referring now to the drawing, a workpiece of fabric is referred to generally by reference numeral 10. Workpiece 10 has a partially completed edging 12 according to the present invention. A process according to the present invention for edging workpiece 10 includes rolling edge 14 by feeding it loosely (as shown in FIG. 2) into rolled hemmer 16 and sewing the rolled edge with a tight zig-zag stitch 18 which overlaps at point 19 at the outer fold 20 of the edging. A tight stitch in this context would be a short stitch with adjacent stitches close together. In one arrangement, the zig-zag stitches are wider than the rolled portion of edge 14 and completely cross over the rolled edge at points 19 and 21 as more clearly shown in FIG. 2. Although the stitch setting is for a width which is wider than the width of edging 12, the thread is pulled tight by the natural action of sewing machine 22 which is to pull the thread tight, causing the rolled effect of edging 12.

Sewing machine 22 holds down rolled edge 14 with presser foot 24 while needle 26 executes the zig-zag stitching. Both upper thread 28 which is fed through needle 26 and a lower thread which is fed through a bobbin, not shown but well known in the art, are made of cotton for a thicker edging. Upper thread 28 can be changed to filament for a medium thickness, and both threads can be filament for a finer edging.

Referring specifically to FIG. 2, a process according to the present invention includes, in one arrangement, the step of placing a stiffener 30 such as a fishing line or a piece of wire along edge 14 so that it will be within the roll of fabric and within edging 12.

From the foregoing it will be seen that this invention is one well adapted to attain all of the ends and objects hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawing is to be interpreted as illustrative and not in a limiting sense.

I claim:

1. The process for edging an openwork fabric to form a rolled edge appearance, comprising the steps of:

rolling an outermost edge of the fabric to be edged into a relatively loose foldover relation;

sewing the rolled outermost edge with a zig-zag stitch which overlaps the outer fold of the rolled portion of the edge wherein the width of the zig-gap stitch is at least twice as great as the length with a stitch width of from about 2–4 millimeters and a stitch length of from about 01–1.0 millimeters; and pulling the zig-zag stitches tight, causing a rolled edge effect in the openwork fabric.

2. A fabric having an edging produced by the process of claim 1.

3. The process according to claim 1 wherein the zig-zag stitch width is approximately 3 millimeters and the zig-zag stitch length is approximately 0.02 millimeters.

4. The process according to claim 1 wherein the step of rolling the outermost edge of the fabric is preceded by a step of placing a stiffener along the edge wherein the stiffener is embodied within the edging.

5. A fabric having an edging produced by the process of claim 4.

6. The process according to claim 1 wherein the zig-zag stitch is wider than the rolled portion of the edge and completely crosses over the rolled edge.

7. A fabric having an edging produced by the process of claim 6.

8. The process according to claim 6 wherein the zig-zag stitch width is approximately 3 millimeters and the zig-zag stitch length is approximately 0.02 millimeters.

9. The process for edging an openwork fabric to form a rolled edge appearance, comprising the steps of:

rolling an outermost edge of the fabric to be edged into a relatively loose foldover relation;

sewing the rolled outermost edge with a zig-zag stitch which overlaps the outer fold of the rolled portion of the edge wherein the width of the zig-zag stitch is at least twice as great as the length; and pulling the zig-zag stitches tight, causing a rolled edge effect in the openwork fabric, wherein the zig-zag stitch width is from about 2 to about 4 millimeters and the zig-zag stitch length is from about 0.01 to about 1.0 millimeters and wherein the step of sewing the zig-zag stitch involves using both an upper thread of filament and a lower thread of cotton.

10. A fabric having an edging produced by the process of claim 9.

11. The process according to claim 9 wherein the zig-zag stitch width is approximately 3 millimeters and the zig-zag stitch length is approximately 0.02 millimeters.

12. The process according to claim 9 wherein the step of rolling the outermost edge of the fabric is preceded by a step of placing a stiffener along the edge wherein the stiffener is within the edging.

13. A fabric having an edging produced by the process of claim 12.

14. The process according to claim 9 wherein the zig-zag stitch is wider than the rolled portion of the edge and completely crosses over the rolled edge.

15. A fabric having an edging produced by the process of claim 14.

16. The process according to claim 14 wherein the zig-zag stitch width is approximately 3 millimeters and the zig-zag stitch length is approximately 0.02 millimeters.

17. The process for edging an openwork fabric to form a rolled edge appearance, comprising the steps of:

rolling an outermost edge of the fabric to be edged into relatively loose foldover relation;

sewing the rolled outermost edge with a zig-zag stitch which overlaps the outer fold of the rolled portion of the edge wherein the width of the zig-zag stitch is at least twice as great as the length; and pulling the zig-zag stitches tight, causing a rolled edge effect in the openwork fabric, wherein the zig-zag stitch width is from about 2 to about 4 millimeters and the zig-zag stitch length is from about 0.01 to about 1.0 millimeters and wherein the step of sewing the zig-zag stitch involves using both an upper thread of filament and a lower thread of filament.

18. A fabric having an edging produced by the process of claim 17.

19. The process according to claim 17 wherein the zig-zag stitch width is approximately 3 millimeters and the zig-zag stitch length is approximately 0.02 millimeters.

20. The process according to claim 17 wherein the step of rolling the outermost edge of the fabric is preceded by a step of placing a stiffener along the edge wherein the stiffener is embodied within the edging.

21. A fabric having an edging produced by the process of claim 20.

22. The process according to claim 17 wherein the zig-zag stitch is wider than the rolled portion of the edge and completely crosses over the rolled edge.

23. A fabric having an edging produced by the process of claim 22.

24. The process according to claim 22 wherein the zig-zag stitch width is approximately 3 millimeters and the zig-zag stitch length is approximately 0.02 millimeters.

25. The process for edging an openwork fabric to form a rolled edge appearance, comprising the steps of:

feeding an outermost edge of the fabric into a fabric folder to roll said edge into a relatively loose foldover relation;

sewing the rolled outermost edge leaving the folder with a zig-zag stitch which overlaps the outer fold of the rolled portion of the edge wherein the width of the zig-zag stitch is at least twice as great as the length; and pulling the zig-zag stitches tight, causing a rolled edge effect in the openwork fabric, wherein the zig-zag stitch width is from about 2 to about 4 millimeters and the zig-zag stitch length is from about 0.01 to about 1.0 millimeters.

26. The process according to claim 25 wherein the zig-zag stitch width is approximately 3 millimeters and the zig-zag stitch length is approximately 0.02 millimeters.

27. A fabric having an edging produced by the process of claim 25.

28. The process according to claim 25 wherein the zig-zag stitch is wider than the rolled portion of the edge and completely crosses over the rolled edge.

29. A fabric having an edging produced by the process of claim 28.

30. The process according to claim 28 wherein the zig-zag stitch width is approximately 3 millimeters and the zig-zag stitch length is approximately 0.02 millimeters.

31. The process according to claim 28 wherein the step of rolling the outermost edge of the fabric is preceded by a step of placing a stiffener along the edge wherein the stiffener is embodied within the edging.

32. A fabric having an edging produced by the process of claim 31.

33. The process for edging an openwork fabric to form a rolled edge appearance, comprising the steps of:

feeding an outermost edge of the fabric into a fabric folder to roll said edge into a relatively loose fold-over relation;

sewing the rolled outermost edge leaving the folder with a zig-zag stitch which overlaps the outer fold of the rolled portion of the outermost edge wherein the width of the zig-zag stitch is at least twice as great as the length; and pulling the zig-zag stitches tight, causing a rolled edge effect in the openwork fabric, wherein the zig-zag stitch width is from about 2 to about 4 millimeters and the zig-zag stitch length is from about 0.01 to about 1.0 millimeters and wherein the step of sewing the zig-zag stitch involves using both an upper thread of filament and a lower thread of cotton.

34. The process according to claim 33 wherein the zig-zag stitch width is approximately 3 millimeters and the zig-zag stitch length is approximately 0.02 millimeters.

35. A fabric having an edging produced by the process of claim 33.

36. The process according to claim 33 wherein the zig-zag stitch is wider than the rolled portion of the outermost edge and completely crosses over the rolled edge.

37. A fabric having an edging produced by the process of claim 36.

38. The process according to claim 36 wherein the zig-zag stitch width is approximately 3 millimeters and the zig-zag stitch length is approximately 0.02 millimeters.

39. The process according to claim 36 wherein the step of rolling the outermost edge of the fabric is preceded by a step of placing a stiffener along the edge wherein the stiffener is embodied within the edging.

40. A fabric having an edging produced by the process of claim 39.

41. The process for edging an openwork fabric to form a rolled edge appearance, comprising the steps of:

feeding an outermost edge of the fabric into a fabric folder to roll said edge into a relatively loose fold-over relation;

sewing the rolled outermost edge leaving the folder with a zig-zag stitch overlaps the outer focld of the rolled portion of the edge wherein the width of the zig-zag stitch is at least twice as great as the length; and pulling the zig-zag stitches tight, causing a rolled edge effect in the open work fabric, wherein the zig-zag stitch width is from about 2 to about 4 millimeters and the zig-zag stitch length is from about 0.01 to about 1.0 millimeters and wherein the step of sewing the zig-zag stitch involves using both an upper thread of filament and a lower thread of filament.

42. The process according to claim 41 wherein the zig-zag stitch width is approximately 3 millimeters and the zig-zag stitch length is approximately 0.02 millimeters.

43. A fabric having an edging produced by the process of claim 41.

44. The process according to claim 41 wherein the zig-zag stitch is wider than the rolled portion of the edge and completely crosses over the rolled edge.

45. A fabric having an edging produced by the process of claim 44.

46. The process according to claim 44 wherein the zig-zag stitch width is approximately 3 millimeters and the zig-zag stitch length is approximately 0.02 millimeters.

47. The process according to claim 44 wherein the step of rolling the outermost edge of the fabric is preceded by a step of placing a stiffener along the edge wherein the stiffener is embodied within the edging.

48. A fabric having an edging produced by the process of claim 47.

49. The process for edging an openwork fabric to form a rolled edge appearance, comprising the steps of:

feeding an outermost edge of the fabric into a fabric folder to roll said edge into a relatively loose fold-over relation;

sewing the rolled outermost edge leaving the folder with a zig-zag stitch which overlaps the outer fold of the rolled portion of the edge wherein the width of the zig-zag stitch is at least twice as great as the length; and pulling the zig-zag stitches tight, causing a rolled edge effect in the openwork fabric, wherein the zig-zag stitch width is from about 2 to about 4 millimeters and the zig-zag stitch length is from about 0.01 to about 1.0 millimeters and wherein the step of rolling the outermost edge of the fabric is preceded by a step of placing a stiffener along the edge wherein the stiffener is embodied within the edging.

50. The process according to claim 49 wherein the zig-zag stitch width is approximately 3 millimeters and the zig-zag stitch length is approximately 0.02 millimeters.

51. A fabric having an edging produced by the process of claim 49.

52. The process according to claim 49 wherein the zig-zag stitch is wider than the rolled portion of the edge and completely crosses over the rolled edge.

53. A fabric having an edging produced by the process of claim 52.

54. The process according to claim 52 wherein the zig-zag stitch width is approximately 3 millimeters and the zig-zag stitch length is approximately 0.02 millimeters.

* * * * *